US007341033B2

(12) United States Patent
Yoshijima et al.

(10) Patent No.: US 7,341,033 B2
(45) **Date of Patent: *Mar. 11, 2008**

(54) CYLINDER HEAD COVER

(75) Inventors: Kazuya Yoshijima, Okazaki (JP); Naohiro Hasegawa, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/653,269

(22) Filed: Jan. 16, 2007

(65) Prior Publication Data

US 2007/0113812 A1 May 24, 2007

Related U.S. Application Data

(63) Continuation of application No. 11/282,489, filed on Nov. 21, 2005, now Pat. No. 7,162,986.

(30) Foreign Application Priority Data

Nov. 24, 2004 (JP) ..... 2004-339363

(51) Int. Cl.
*F01M 1/10* (2006.01)

(52) U.S. Cl. ..... 123/90.38; 123/90.12; 123/90.13; 123/193.5

(58) Field of Classification Search ..... 123/90.38, 123/90.33, 90.12, 90.13, 193.5, 195 C, 90.15, 123/90.16, 90.17, 90.18
See application file for complete search history.

(56) References Cited

U.S. PATENT DOCUMENTS

| | | | |
|---|---|---|---|
| 5,423,295 A | 6/1995 | Murata et al. | |
| 5,771,850 A | 6/1998 | Okada | |
| 6,591,796 B1 | 7/2003 | Scott | |
| 6,684,836 B2 | 2/2004 | Inoue et al. | |
| 7,162,986 B2 * | 1/2007 | Yoshijima et al. | 123/90.38 |
| 2004/0144349 A1 | 7/2004 | Wampula et al. | |
| 2006/0000434 A1 | 1/2006 | Yoshijima et al. | |
| 2006/0011158 A1 | 1/2006 | Yoshijima et al. | |
| 2006/0027199 A1 | 2/2006 | Yoshijima et al. | |

FOREIGN PATENT DOCUMENTS

| | | |
|---|---|---|
| EP | 1 333 159 | 8/2003 |
| JP | 4-109007 | 4/1992 |
| JP | 11-132016 | 5/1999 |
| JP | 2003-232260 | 8/2003 |
| JP | 2003-314360 | 11/2003 |
| JP | 2006-46083 | 2/2006 |
| JP | 2006-200389 | 8/2006 |

OTHER PUBLICATIONS

European Search Report dated Jan. 9, 2006.
European Office Action dated Dec. 12, 2006.

* cited by examiner

*Primary Examiner*—Ching Chang
(74) *Attorney, Agent, or Firm*—Finnegan, Henderson, Farabow, Garrett & Dunner, LLP

(57) ABSTRACT

First and second attachment portions 6, 8 are formed integrally with a main body 4 and extend along the longitudinal direction of the main body 4. A hydraulic oil supply portion 14 is formed integrally with the main body 4 and extends along the width, or in the direction perpendicular to the axes of the attachment portions 6, 8. In this manner, providing an internal combustion engine with variable valve actuation mechanisms increases the strength of the cylinder head cover 102, while reducing the weight thereof.

8 Claims, 8 Drawing Sheets

CYLINDER HEAD COVER

This is a continuation of application Ser. No. 11/282,489, filed Nov. 21, 2005 now U.S. Pat. No. 7,162,986, based on Japanese Patent Application No. 2004-339363, filed Nov. 24, 2004, in Japan, all of which are incorporated herein by reference.

BACKGROUND OF THE INVENTION

The present invention relates to a cylinder head cover for an internal combustion engine.

In recent years, internal combustion engines equipped with hydraulic variable valve actuation mechanisms have been in practical use. Such an internal combustion engine has variable valve actuation mechanisms provided in the vicinity of camshafts. The variable valve actuation mechanisms are actuated by supply and drainage of hydraulic oil to and from the mechanisms. Specifically, such supply and drainage of hydraulic oil are switched through control performed by an oil control valve. The valve timing of intake valves and exhaust valves are thus adjusted. An apparatus that is capable of varying the valve timing of an internal combustion engine as shown above is disclosed in Japanese Patent No. 3525709.

In the configuration disclosed in the above document, a valve case is attached to the top of a cylinder head cover, and an oil control valve is provided in the valve case. Hydraulic oil circulating in a cylinder head is supplied to the oil control valve attached to an upper portion of the cylinder head cover through supply piping formed about the cylinder head. In this configuration, the supply piping is typically formed by coupling metal pipes to one another with union bolts and oil joints.

In such piping, metal pipes need to be supported in a state separated from the surface of the cylinder head cover using supporting members such as union bolts. As a result, the number of components is increased, and the weight of the internal combustion engine is increased, accordingly. This could adversely affect the fuel economy performance. Also, resonance in the metal pipes due to operation of the internal combustion engine could adversely affect the sealing performance of the union bolts and the oil joints.

Recently, to reduce the weight and suppress noise of internal combustion engines, use of resin cylinder head covers have been studied. However, as long as supply piping is formed of metal pipes as discussed above, the problems of an increased number of components and reduced sealing performance are not solved by resin cylinder head covers. This leads to the idea of supply piping integrated with the cylinder head cover of an internal combustion engine.

However, in the case where the supply piping is integrated with the cylinder head cover, as well as in the case where a cylinder head cover is formed of resin, the mere integration of the components does not satisfy the demands. That is, it is desired that such integration increase the strength and reduce the weight of cylinder head covers.

SUMMARY OF THE INVENTION

Accordingly, it is an objective of the present invention to provide a cylinder head cover that receives an oil control valve and has high strength and reduced weight.

To achieve the foregoing and other objectives of the present invention, a cylinder head cover for attachment to a cylinder head of an internal combustion engine is provided. The engine has a hydraulic variable valve actuation mechanism and an oil control valve that switches supply and drainage of hydraulic oil to and from the variable valve actuation mechanism. The cylinder head cover includes a main body, an attachment portion, and a hydraulic oil supply portion. The oil control valve is attached to the attachment portion. The hydraulic oil supply portion supplies hydraulic oil drawn from the cylinder head to the oil control valve. The attachment portion is formed integrally with the main body and extends along a longitudinal direction of the main body. The hydraulic oil supply portion is formed integrally with the main body and extends along a direction substantially perpendicular to an axis of the attachment portion.

The present invention also provides a cylinder head cover for attachment to a cylinder head of an internal combustion engine. The engine has a plurality of hydraulic variable valve actuation mechanisms and a plurality of oil control valves each of which switches supply and drainage of hydraulic oil to and from one of the variable valve actuation mechanisms. The cylinder head cover includes a main body, a plurality of attachment portions, and a hydraulic oil supply portion. Each oil control valve is attached to one of the attachment portions. The hydraulic oil supply portion supplies hydraulic oil drawn from the cylinder head to the oil control valves. The attachment portions are formed integrally with the main body and extend along a longitudinal direction of the main body. The hydraulic oil supply portion is formed integrally with the main body and extends along a direction substantially perpendicular to axes of the attachment portions.

Further, the present invention provides an internal combustion engine for a vehicle. The engine includes a cylinder block, a cylinder head mounted on the cylinder block, a cylinder head cover attached to the cylinder head, a plurality of hydraulic variable vale actuation mechanisms, a plurality of oil control valves each of which switches supply and drainage of hydraulic oil to and from one of the variable valve actuation mechanisms, a plurality of attachment portions to each of which the one of the oil control valves is attached, and a hydraulic oil supply portion for supplying hydraulic oil drawn from the cylinder head to the oil control valves. The attachment portions are formed integrally with the cylinder head cover and extend along a longitudinal direction of the cylinder head cover. The hydraulic oil supply portion is formed integrally with the cylinder head cover and extends along a direction substantially perpendicular to axes of the attachment portions.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A cylinder head cover 2 according to a first embodiment of the present invention will now be described with reference to FIGS. 1 to 3.

Figure 1:
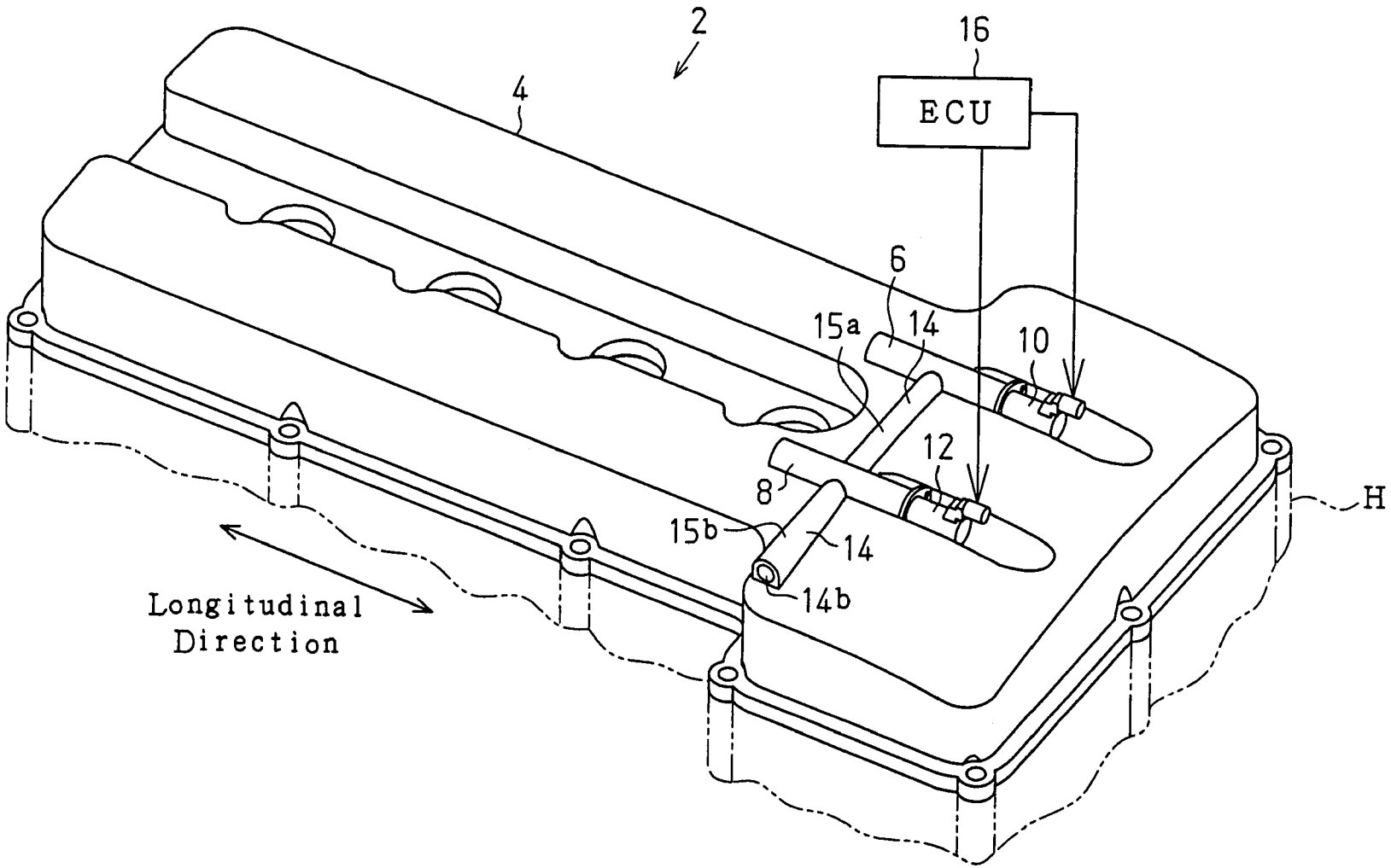
FIG. 1 is a perspective view illustrating a cylinder head cover according to a first embodiment.
Figure 2:
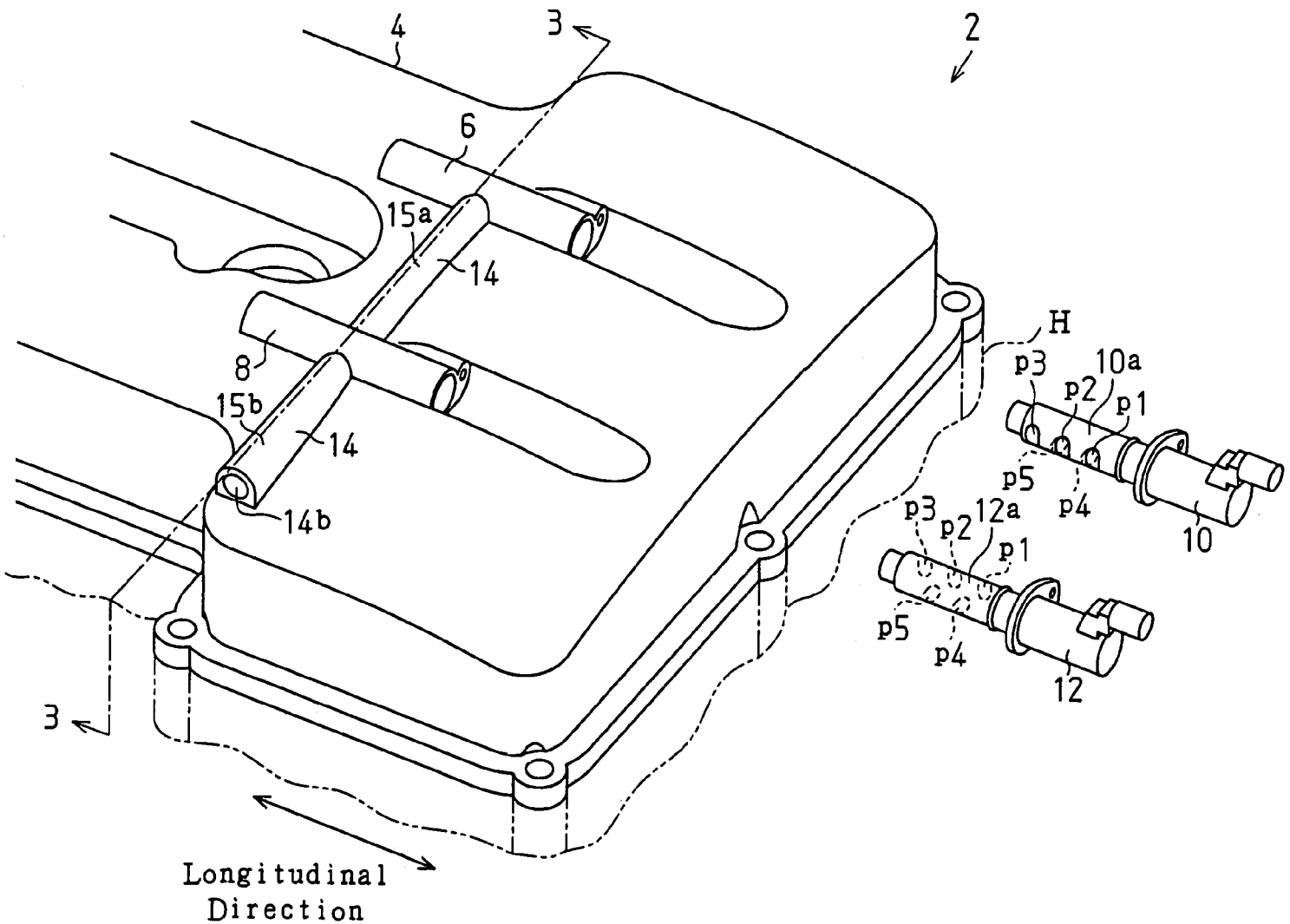
FIG. 2 is a partial enlarged perspective view illustrating the cylinder head cover of the first embodiment.

As shown in FIGS. 1 and 2, the cylinder head cover 2 includes a resin main body 4. The main body 4 has first and second attachment portions 6, 8 for receiving oil control valves (hereinafter, each is referred to as an OCV). The first and second attachment portions 6, 8 are integrally formed with the main body 4. The cylinder head cover 2 of this embodiment is applied to an internal combustion engine for a vehicle that includes variable valve actuation mechanisms for varying the valve timing of intake valves and exhaust valves.

The attachment portions 6, 8 each extend along a longitudinal direction of the main body 4. The attachment portions 6, 8 are arranged along a direction of the width of the main body 4 that is perpendicular to the longitudinal direction such that axes of the attachment portions 6, 8 are parallel to each other. The first attachment portion 6 receives a first OCV 10 that supplies and drains hydraulic oil to and from a variable valve actuation mechanism for intake valves that adjusts the valve timing of the intake valves. The second attachment portion 8 receives a second OCV 12 that supplies and drains hydraulic oil to and from a variable valve actuation mechanism for exhaust valves that adjusts the valve timing of the exhaust valves.

The OCVs 10, 12 are connected to an electronic control unit (hereinafter, referred to as an ECU) 16, and operate in response to output signals from the ECU 16. The ECU 16 controls the OCVs 10, 12 to supply hydraulic oil to a phase advancing side or a phase retarding side of each of the variable valve actuation mechanisms. Through control of the OCVs 10, 12, the valve timing of the intake valves and the valve timing of the exhaust valves are retarded or advanced, so that the valve overlap amount of the intake valves and the exhaust valves is changed as necessary.

The main body 4 has a hydraulic oil supply portion 14 for supplying hydraulic oil to the attachment portions 6, 8. The hydraulic oil supply portion 14 is integrally formed with the main body 4. The hydraulic oil supply portion 14 extends in the direction along which the attachment portions 6, 8 are arranged, or along the width of the main body 4 that is perpendicular to the axes of the attachment portions 6, 8. The hydraulic oil supply portion 14 includes a first section 15*a* connected to the attachment portions 6, 8, and a second section 15*b* extending outward from the second attachment portion 8. The first and second sections 15*a*, 15*b* are arranged coaxially. When molding the cylinder head cover 2, a pin is placed in a position corresponding to the hydraulic oil supply portion 14. Then, molten resin is injected into the mold and cured. Subsequently, the pin is removed. The coaxial structure of the first and second sections 15*a*, 15*b* facilitates the removal of the pin. An opening formed by removal of the pin from the main body 4 receives a resin plug 14*b*. The plug 14*b* is welded to the main body 4 to close the opening (see FIG. 3).

Figure 3:
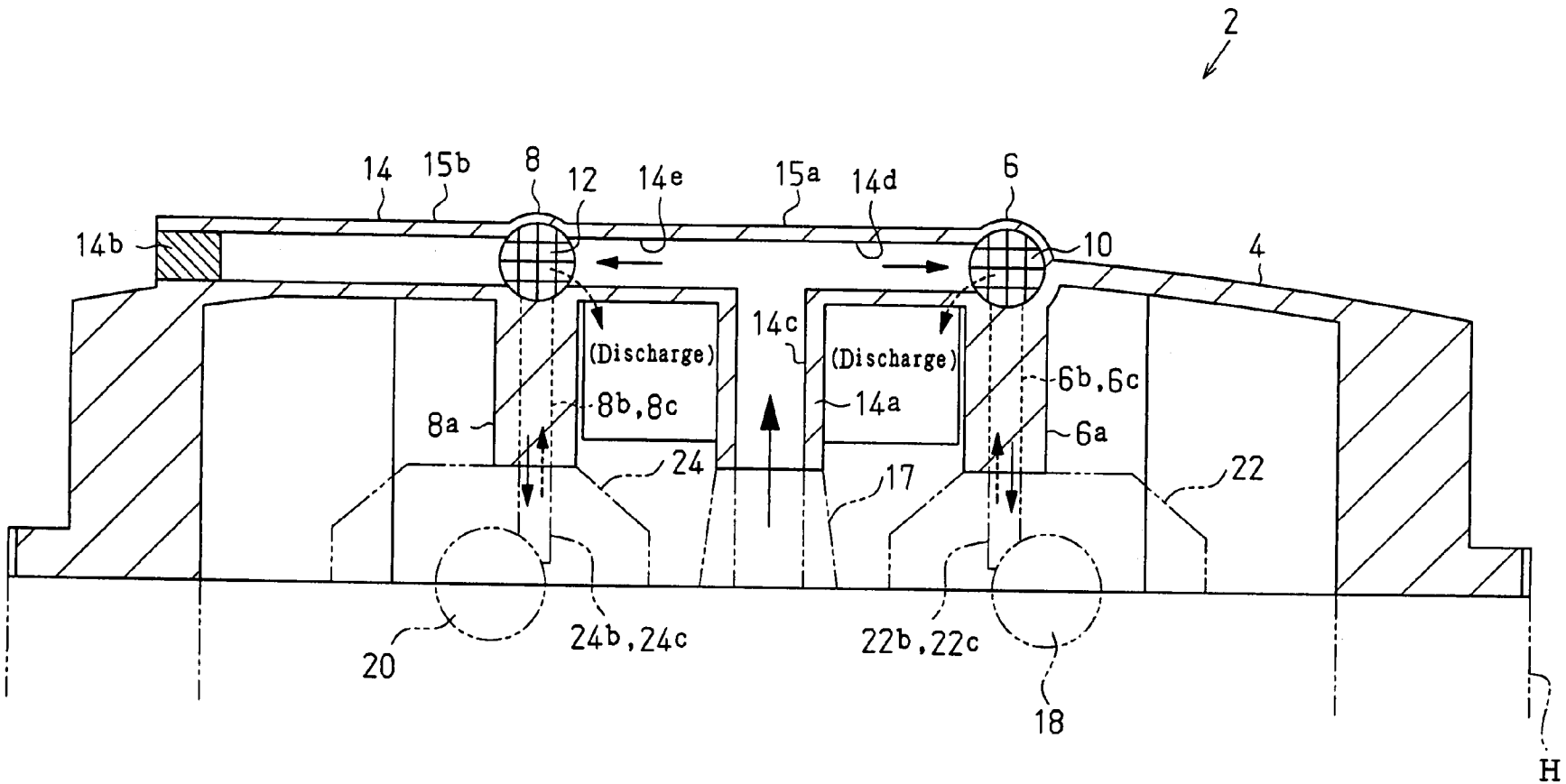
FIG. 3 is a cross-sectional view taken along line 3-3 in FIG. 2.

As shown in FIG. 3, a hydraulic oil inlet section 14*a* for drawing hydraulic oil from a cylinder head H to the hydraulic oil supply portion 14 is formed in the main body 4. The hydraulic oil inlet section 14*a* extends along the thickness of the main body 4 from a middle position between the first attachment portion 6 and the second attachment portion 8 in the hydraulic oil supply portion 14 toward the cylinder head H. An oil passage 14*c* is defined in the hydraulic oil inlet section 14*a*. The oil passage 14*c* communicates with an oil passage in the first section 15*a* of the hydraulic oil supply portion 14.

With the cylinder head cover 2 attached to the cylinder head H, the hydraulic oil inlet section 14*a* is connected to a hydraulic pressure supply portion 17 of the cylinder head H. In this state, hydraulic oil is supplied to the hydraulic oil supply portion 14 from the cylinder head H through the hydraulic oil inlet section 14*a*, and distributed to the first OCV 10 attached to the first attachment portion 6.and the second OCV 12 attached to the second attachment portion 8. That is, the oil passage in the hydraulic oil supply portion 14 is divided into a distribution passage 14*d* for supplying hydraulic oil to the first attachment portion 6 and a distribution passage 14*e* for supplying hydraulic oil to the second attachment portion 8.

Hydraulic oil supplied from the cylinder head H to the attachment portions 6, 8 of the cylinder head cover 2 is sent to the interior of the OCVs 10, 12 through inlet ports p2 formed in spool housings 10*a*, 12*a* of the OCVs 10, 12 (see FIG. 2). At this time, in accordance with the position of a spool in each of the spool housings 10*a*, 12*a*, whether hydraulic oil is supplied to a phase retarding port p4 or a phase advancing port p5 of each of the OCVs 10, 12 is determined. Also, depending on the positions of the spools, hydraulic oil is supplied to neither the phase retarding ports p4 nor the phase advancing ports p5.

As shown in FIG. 3, a first connection portion 6*a* and a second connection portion 8*a* are formed in the main body 4. The first connection portion 6*a* is connected to a cam cap 22 of an intake camshaft 18, and the second connection portion 8*a* is connected to a cam cap 24 of an exhaust camshaft 20. Further, a phase retarding passage 6*b* and a phase advancing passage 6*c* are formed in the first connection portion 6*a*. Likewise, a phase retarding passage 8*b* and a phase advancing passage 8*c* are formed in the second connection portion 8*a*.

The phase retarding ports p4 of the OCVs 10, 12 are connected to phase retarding passages 22*b*, 24*b* in the cam caps 22, 24 through the phase retarding passages 6*b*, 8*b*, respectively. The phase advancing ports p5 of the OCVs 10, 12 are connected to phase advancing passages 22*c*, 24*c* in the cam caps 22, 24 through the phase advancing passages 6*c*, 8*c*, respectively. Through an oil passage (not shown) defined in the intake camshaft 18, the phase retarding passage 22*b* in the cam cap 22 communicates with a phase retarding mechanism of the variable valve actuation mechanism for the intake valves, and the phase advancing passage 22*c* of the cam cap 22 communicates with a phase advancing mechanism of the variable valve actuation mechanism for the intake valves. Likewise, through an oil passage (not shown) defined in the exhaust camshaft 20, the phase retarding passage 24*b* in the cam cap 24 communicates with a phase retarding mechanism of the variable valve actuation mechanism for the exhaust valves, and the phase advancing passage 24*c* of the cam cap 24 communicates with a phase advancing mechanism of the variable valve actuation mechanism for the exhaust valves.

When hydraulic oil is supplied to either of the phase retarding ports p4 or the phase advancing ports p5, hydraulic oil is discharged from the ports to which hydraulic oil is not supplied, and hydraulic oil is discharged to the outside of the OCVs 10, 12 through either drain ports p1 or p3. An oil hole (not shown), communicating with the drain ports p1, p3, is formed in each of the attachment portions 6, 8. Hydraulic oil is drained from the oil holes of the attachment portions 6, 8 to the interior of the main body 4.

The first embodiment provides the following advantages.

(1) The first and second attachment portions 6, 8 are formed integrally with the main body 4 and extend along the longitudinal direction of the main body 4. This structure increases the rigidity of the main body 4 along the longitudinal direction. Also, since the OCVs 10, 12 are received in the attachment portions 6, 8, the rigidity of the main body 4 along the longitudinal direction is further increased.

The hydraulic oil supply portion 14 is formed integrally with the main body 4 and extends along the width, or in the direction perpendicular to the axes of the attachment portions 6, 8. This structure increases the rigidity of the main body 4 along the width.

In this manner, providing the internal combustion engine with variable valve actuation mechanisms increases the rigidity of the main body 4 along the longitudinal direction and the rigidity along the direction of the width that is perpendicular to the longitudinal direction. Accordingly, the rigidity of the main body 4 is increased in a large area, which increases the strength of the cylinder head cover 2. In this case, the main body 4 may be made relatively thin to reduce the weight of the cylinder head cover 2, while maintaining sufficient strength for the main body 4.

Further, the attachment portions 6, 8 are arranged along the width of the main body 4, and the hydraulic oil supply portion 14 is connected to the attachment portions 6, 8. Accordingly, the rigidity of the main body 4 is increased in a large area. The strength of the cylinder head cover 2 is further increased, and reduction of the weight of the cylinder head cover 2 is facilitated.

(2) The hydraulic oil supply portion 14 includes the first section 15*a* connected to the attachment portions 6, 8, and the second section 15*b* extending outward from the second attachment portion 8, and the first and second sections 15*a*, 15*b* are arranged coaxially. Accordingly, the shape of the mold for molding the cylinder head cover 2 is simplified, and the number of pins used for molding is reduced. This reduces the manufacturing costs of the mold and simplifies the manufacturing process of the cylinder head cover 2.

(3) Since the hydraulic oil supply portion 14 has a simple shape without any bent portions, pressure loss produced while hydraulic oil is supplied from the cylinder head H to the attachment portions 6, 8 is minimized.

Second Embodiment

A second embodiment of the present invention will now be described with reference to FIGS. 4 and 5. Like or the same reference numerals in the second embodiment are given to those components that are like or the same as the corresponding components of the first embodiment.

Figure 4:
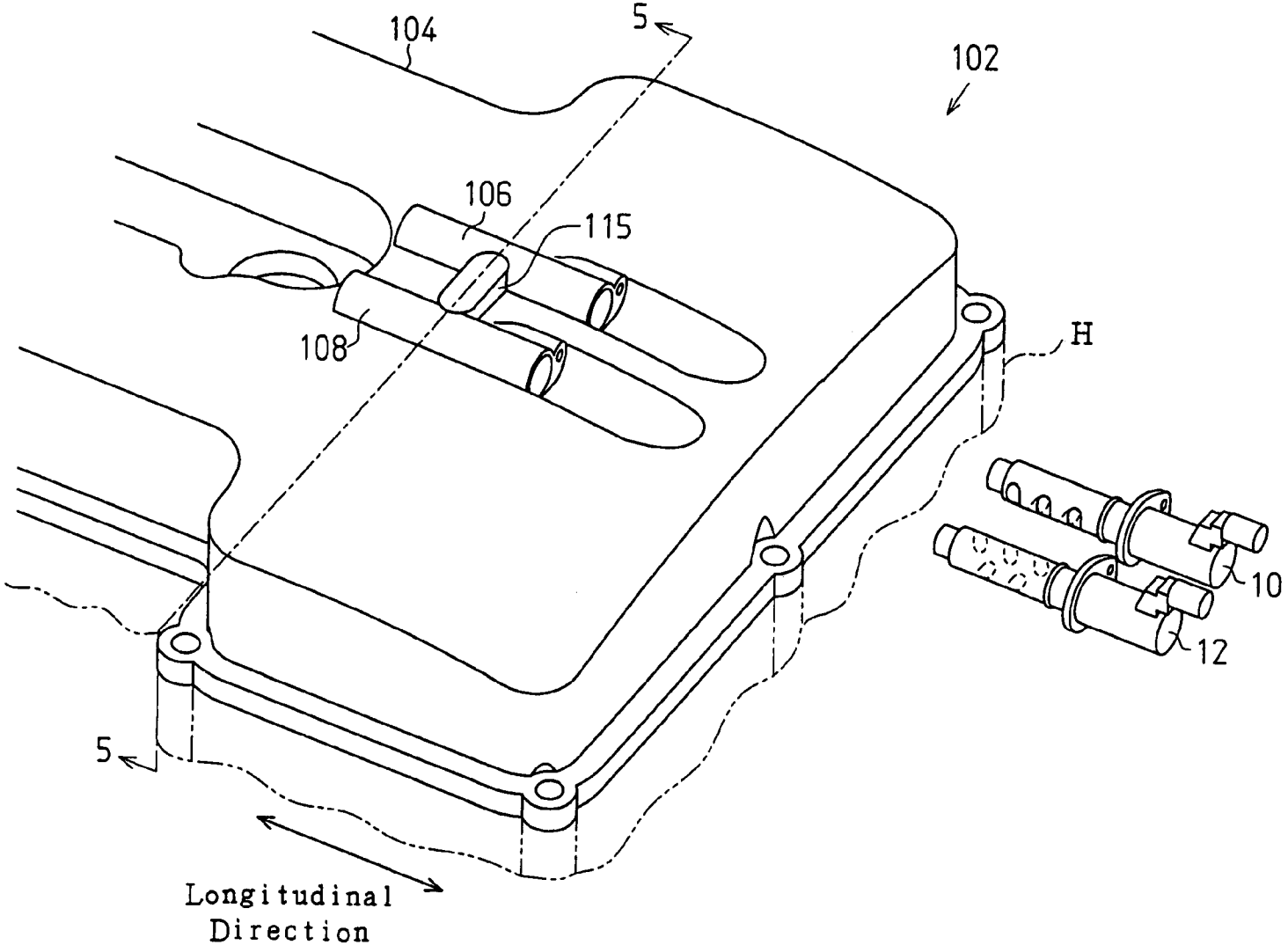
FIG. 4 is a partial enlarged perspective view illustrating a cylinder head cover according to a second embodiment.
Figure 5:
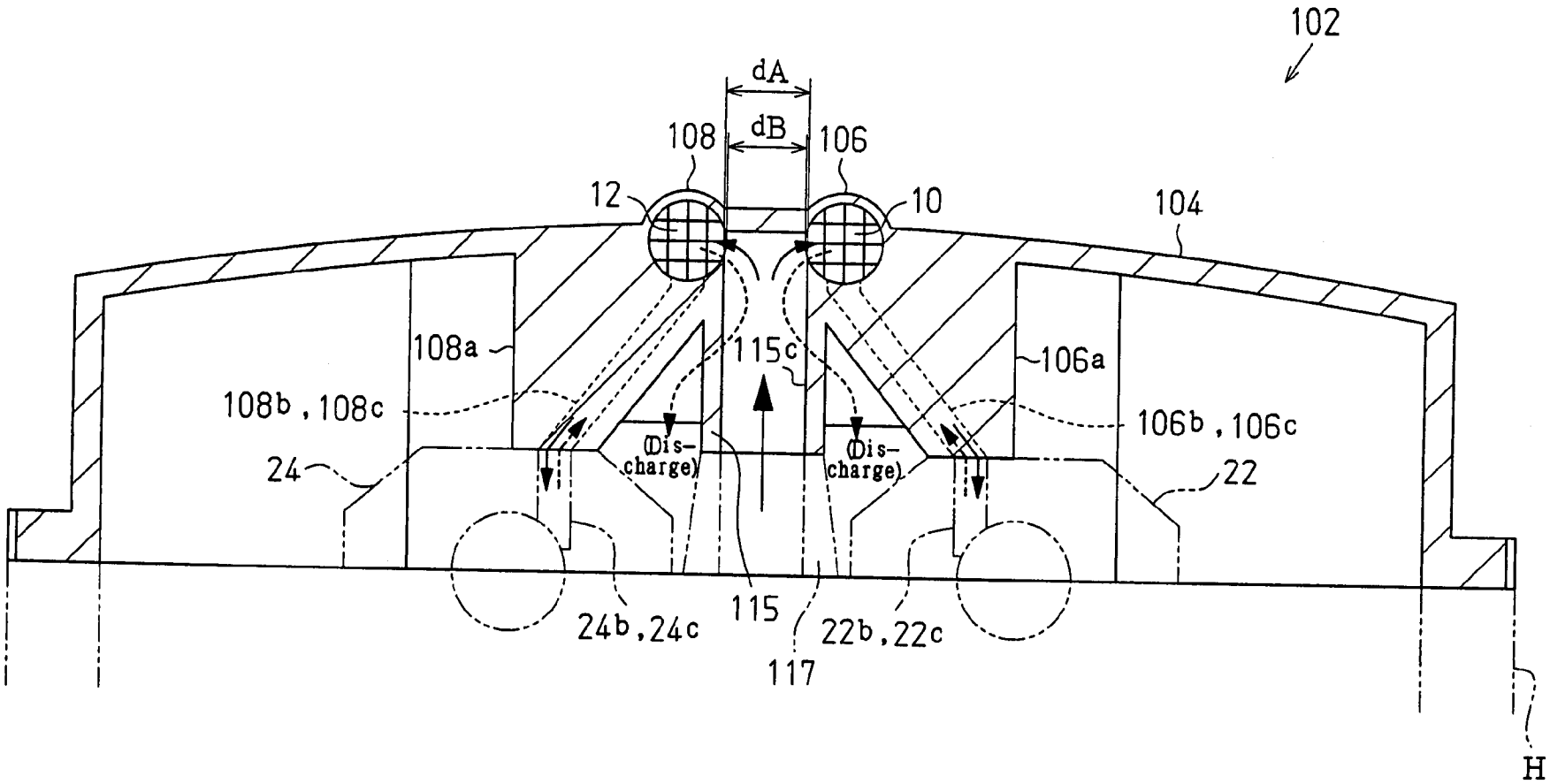
FIG. 5 is a cross-sectional view taken along line 5-5 in FIG. 4.

As shown in FIGS. 4 and 5, first and second attachment portions 106, 108 are integrally formed with a main body 104 of a cylinder head cover 102. However, the cylinder head cover 102 does not have a hydraulic oil supply portion for supplying hydraulic oil to the attachment portions 106, 108.

In this embodiment, the space between the attachment portions 106, 108 is narrow, while hydraulic oil inlet section 115 has a wide cross-sectional area. More specifically, the inner diameter dA of a passage 115*c* in the hydraulic oil inlet section 115 is wider than the space dB between the attachment portions 106, 108. Thus, when the main body 104 is viewed from above, the passage 115*c* in the inlet section 115 partly overlaps the attachment portions 106, 108. Therefore, hydraulic oil is directly supplied from the inlet section 105 to the OCVs 10, 12 received in the attachment portions 106, 108. That is, in this embodiment, the inlet section 115 also functions as a hydraulic oil supply portion for supplying hydraulic oil to the attachment portions 106, 108.

The outer diameter of a hydraulic pressure supply portion 117 of the cylinder head H gradually increases downward toward the cylinder head H. When the cylinder head cover 2 is attached to the cylinder head H, phase retarding and phase advancing passages 106*b*, 106*c* defined in a first connection portion 106*a* each communicate with the corresponding one of the phase retarding and phase advancing passages 22*b*, 22*c* defined in the cam cap 22. Phase retarding and phase advancing passages 108*b*, 108*c* defined in the second connection portion 108*a* each communicate with the corresponding one of the phase retarding and phase advancing passages 24*b*, 24*c* in the cam cap 24.

The second embodiment provides the following advantages.

(1) The first and second attachment portions 106, 108 are formed integrally with the main body 104 and extend along the longitudinal direction of the main body 104. This structure increases the rigidity of the main body 104 along the longitudinal direction, which increases the strength of the cylinder head cover 102. Also, since the OCVs 10, 12 are received in the attachment portions 106, 108, the rigidity of the main body 104 along the longitudinal direction is further increased.

When the main body 104 is viewed from above, the inlet section 115 partly overlaps the attachment portions 106, 108. The inlet section 115 is formed integrally with the main body 104 while being connected to the attachment portions 106, 108. Accordingly, the rigidity of the main body 104 is increased in a large area, which further increases the strength of the cylinder head cover 2.

In this manner, providing the internal combustion engine with variable valve actuation mechanisms increases the strength of the cylinder head cover 102, while reducing the weight of the cylinder head cover 102.

(2) The inlet section 115 functions as a hydraulic oil supply portion for supplying hydraulic oil to the attachment portions 106, 108. Accordingly, the shape of the mold for molding the cylinder head cover 102 is simplified, and the number of pins used for molding is reduced. This reduces the manufacturing cost for the mold and simplifies the manufacturing process of the cylinder head cover 2.

(3) Compared to the configuration of the first embodiment, the passage from the inlet section 115 to the attachment portions 106, 108 is short, and the shape of the passage is simple. Therefore, pressure loss produced while hydraulic oil is supplied from the cylinder head H to the attachment portions 106, 108 is further reduced.

The above described embodiments may be modified as follows.

Figure 6:
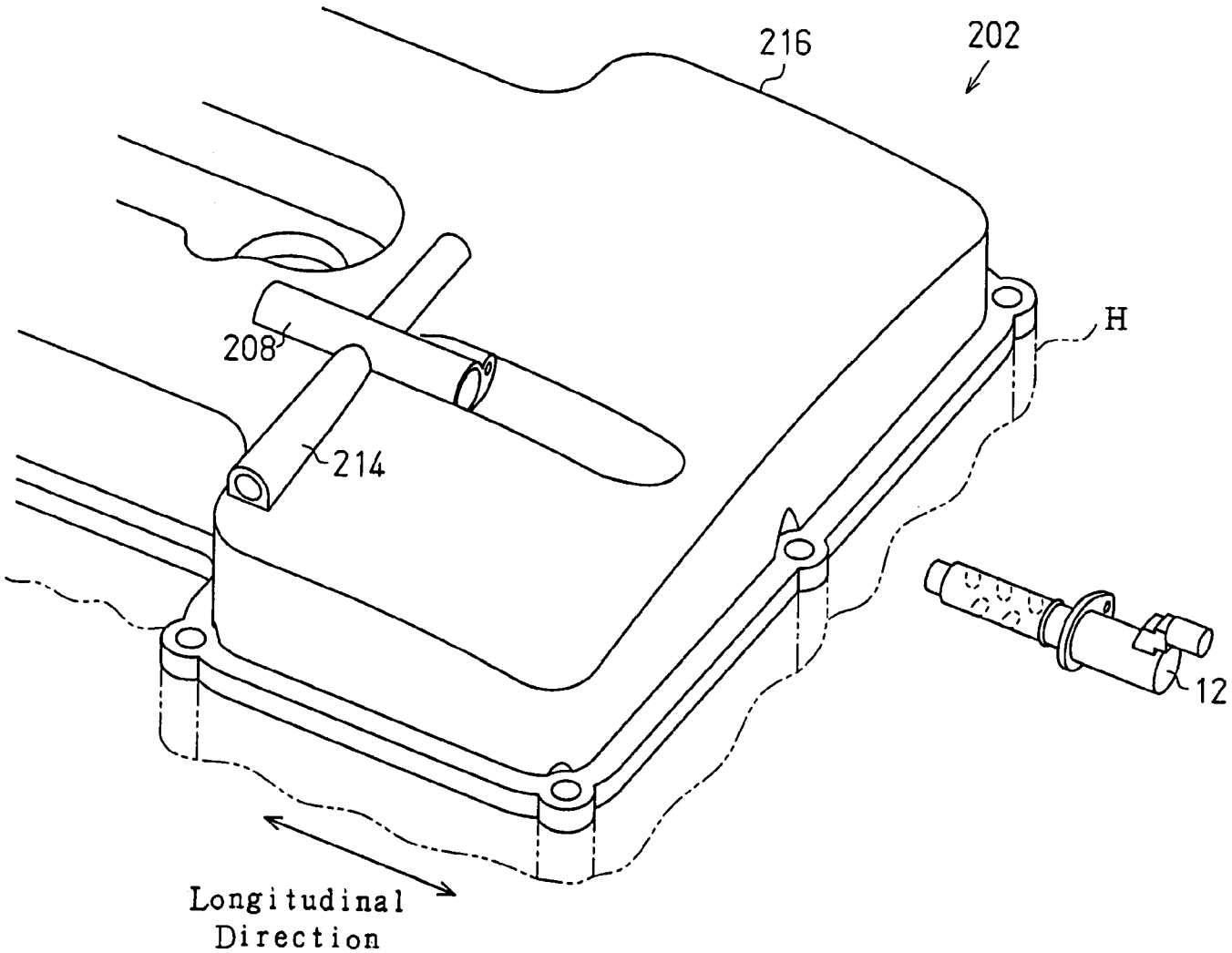
FIG. 6 is a partial enlarged perspective view illustrating a cylinder head cover according to a first modification.
Figure 7:
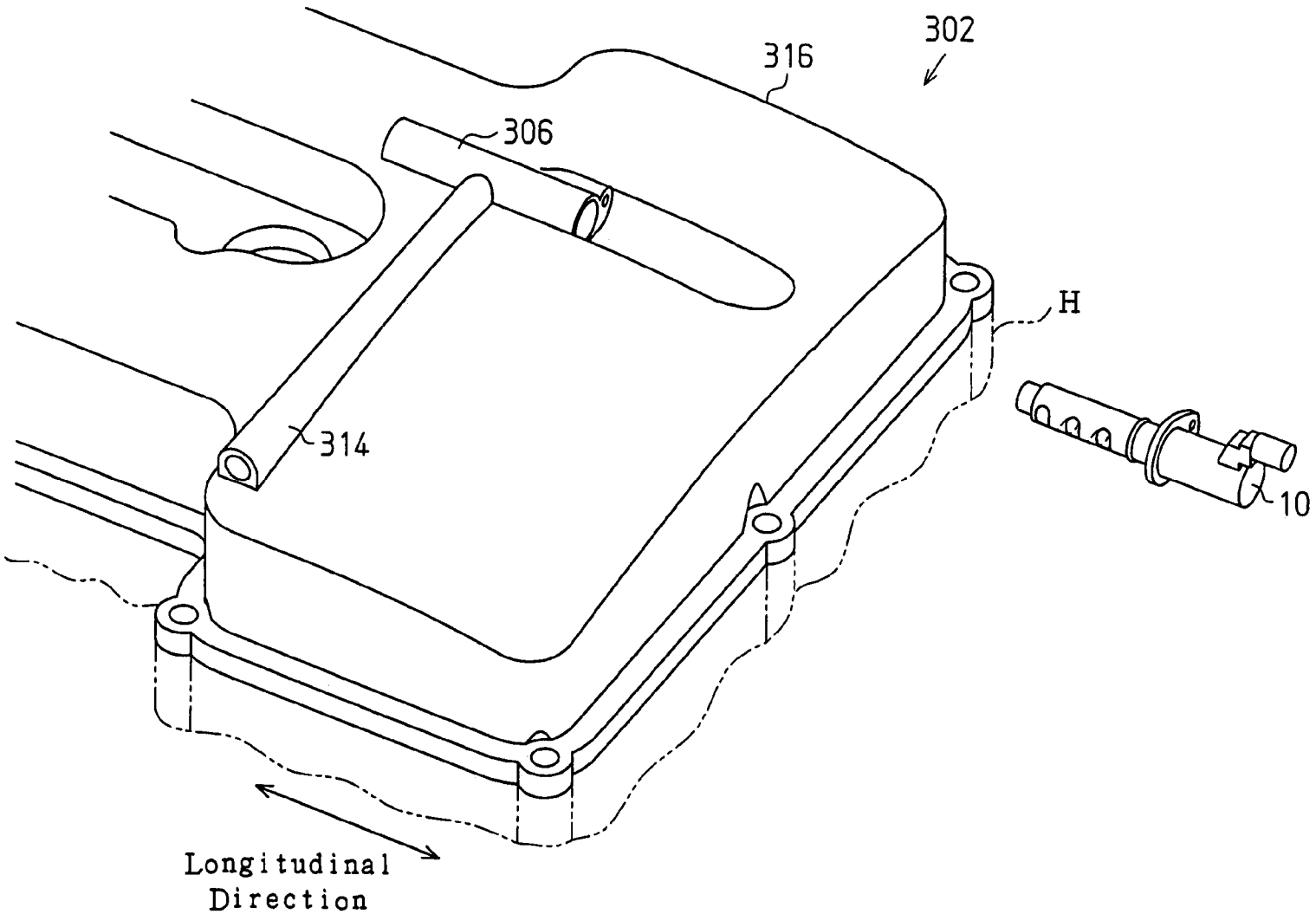
FIG. 7 is a partial enlarged perspective view illustrating a cylinder head cover according to a second modification.

In the above illustrated embodiments, the variable valve actuation mechanisms are provided for both of the intake valves and the exhaust valves. However, only one variable valve actuation mechanism may be provided for one of the set of the intake valves and the set of the exhaust valves. For example, the present invention may be embodied in a cylinder head cover 202 shown in FIG. 6, in which a single attachment portion 208 and a single hydraulic oil supply portion 214 are integrally formed with a main body 216. Alternatively, the present invention may be embodied in a cylinder head cover 302 as shown in FIG. 7, in which a single attachment portion 306 and a hydraulic oil supply portion 314 are formed integrally with a main body 316. In each of these cases, providing the internal combustion engine with a variable valve actuation mechanism increases the rigidity of the main body along the longitudinal direction and the rigidity along the direction of the width that is perpendicular to the longitudinal direction. Accordingly, the strength of the cylinder head cover is increased.

Figure 8:
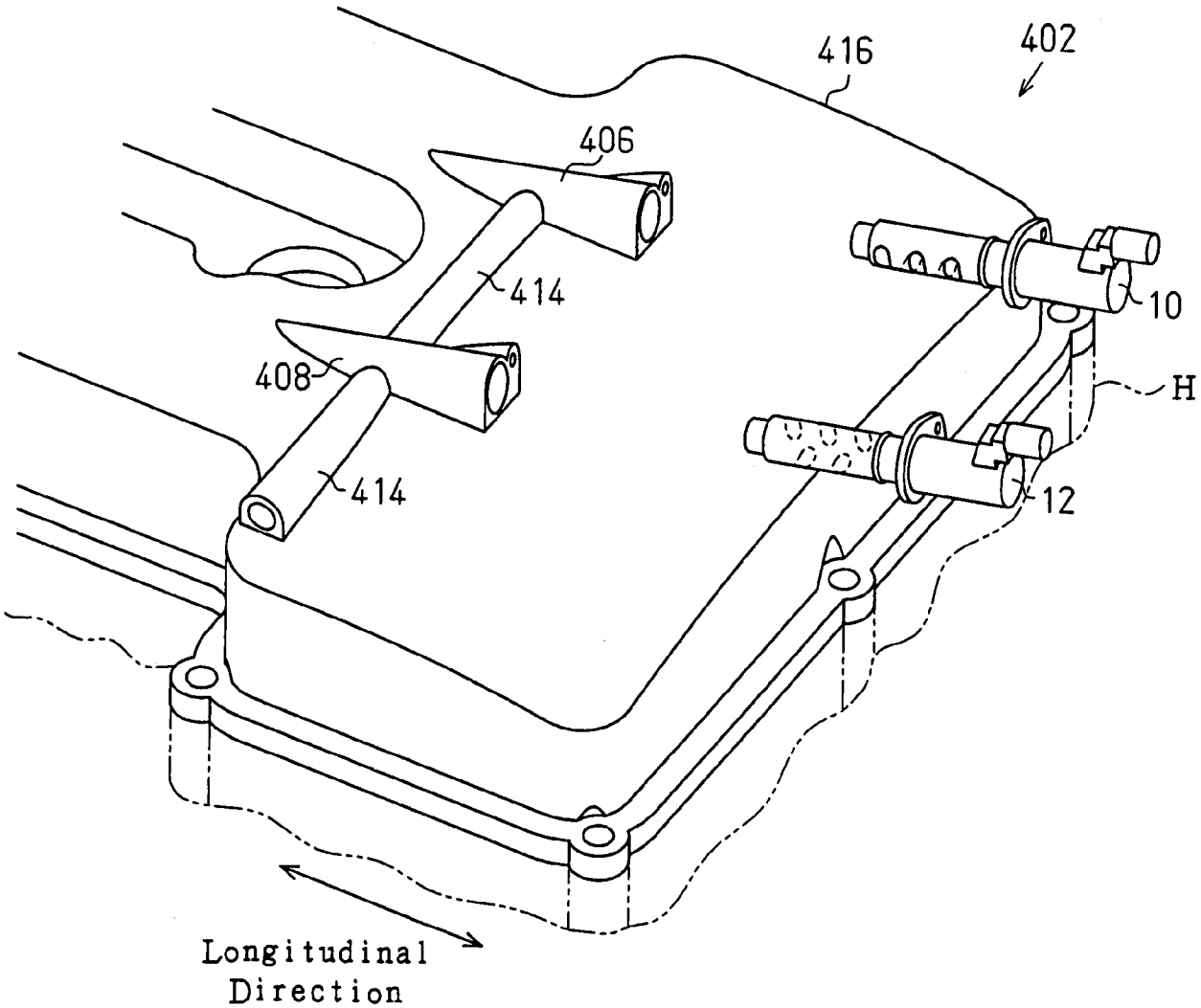
FIG. 8 is a partial enlarged perspective view illustrating a cylinder head cover according to a third modification.

In the illustrated embodiments, the axis of each attachment portion does not need to completely match with the longitudinal direction of the main body. FIG. 8 shows a cylinder head cover 402 according to a modification, in which the axes of attachment portions, 406, 408 are inclined relative to the longitudinal axis of the main body 416.

In the illustrated embodiments, the direction along which the hydraulic oil supply portion extends does not need to be precisely perpendicular to the axes of the attachment portions.

In the illustrated embodiments, the attachment portions do not need to be arranged along a direction of width of the main body.

In the illustrated embodiments, a metal sleeve may be fitted in each of the attachment portions.

Therefore, the present examples and embodiments are to be considered as illustrative and not restrictive and the invention is not to be limited to the details given herein, but may be modified within the scope and equivalence of the appended claims.

The invention claimed is:

1. A cylinder head cover for attachment to a cylinder head of an internal combustion engine, the engine having a hydraulic variable valve actuation mechanism and an oil control valve that switches supply and drainage of hydraulic oil to and from the variable valve actuation mechanism, the cylinder head cover comprising:

a main body;

an attachment portion for attachment of the oil control valve thereto; and a hydraulic oil supply portion for supplying hydraulic oil drawn from the cylinder head to the oil control valve, wherein the attachment portion extends along a longitudinal direction of the main body, wherein the hydraulic oil supply portion extends along a direction substantially perpendicular to an axis of the attachment portion, wherein the hydraulic oil supply portion extends along a width direction of the main body, the width direction being substantially perpendicular to the longitudinal direction of the main body, and wherein the main body, the attachment portion, and the hydraulic oil supply portion are formed integrally of resin.

2. The cylinder head cover according to claim 1, wherein the variable valve actuation mechanism is one of a variable valve actuation mechanism for an intake valve and a variable valve actuation mechanism for an exhaust valve.

3. A cylinder head cover for attachment to a cylinder head of an internal combustion engine, the engine having a plurality of hydraulic variable valve actuation mechanisms and a plurality of oil control valves each of which switches supply and drainage of hydraulic oil to and from one of the variable valve actuation mechanisms, the cylinder head cover comprising:

a main body;

a plurality of attachment portions each of which are for attachment thereto of one of the oil control valves; and a hydraulic oil supply portion for supplying hydraulic oil drawn from the cylinder head to the oil control valves, wherein the attachment portions extend along a longitudinal direction of the main body, wherein the hydraulic oil supply portion extends along a direction substantially perpendicular to axes of the attachment portions, wherein the hydraulic oil supply portion extends along a width direction of the main body, the width direction being substantially perpendicular to the longitudinal direction of the main body, wherein the main body, the attachment portions, and the hydraulic oil supply portion are formed integrally of resin.

4. The cylinder head cover according to claim 3, wherein the attachment portions are arranged along the width direction of the main body, the hydraulic oil supply portion has a plurality of distribution passages for distributing hydraulic oil from the cylinder head to each of the attachment portions, and the distribution passages are arranged coaxially.

5. The cylinder head cover according to claim 3, wherein the variable valve actuation mechanisms are a variable valve actuation mechanism for an intake valve and a variable valve actuation mechanism for an exhaust valve.

6. An internal combustion engine for a vehicle, the engine comprising:

a cylinder block;

a cylinder head mounted on the cylinder block;

a cylinder head cover attached to the cylinder head;

a plurality of hydraulic variable valve actuation mechanisms;

a plurality of oil control valves each of which switches supply and drainage of hydraulic oil to and from one of the variable valve actuation mechanisms;

a plurality of attachment portions to each of which the one of the oil control valves is attached; and a hydraulic oil supply portion for supplying hydraulic oil drawn from the cylinder head to the oil control valves, wherein the attachment portions extend along a longitudinal direction of the main body, wherein the hydraulic oil supply portion extends along a direction substantially perpendicular to axes of the attachment portions, wherein the hydraulic oil supply portion extends along a width direction of the cylinder head cover, the width direction being substantially perpendicular to the longitudinal direction of the cylinder head cover, and wherein the cylinder head cover, the attachment portions, and the hydraulic oil supply portion are formed integrally of resin.

7. The internal combustion engine according to claim 6, wherein the attachment portions are arranged along the width direction of the cylinder head cover, the hydraulic oil supply portion has a plurality of distribution passages for distributing hydraulic oil from the cylinder head to each of the attachment portions, and the distribution passages are arranged coaxially.

8. The internal combustion engine according to claim 6, wherein the variable valve actuation mechanisms are a variable valve actuation mechanism for an intake valve and a variable valve actuation mechanism for an exhaust valve.

* * * * *